United States Patent [19]

Dysarz

[11] Patent Number: 4,829,924

[45] Date of Patent: May 16, 1989

[54] SEMI SUBMERSIBLE DEVICE AND METHOD TO SET AND SALVAGE MARINE SUPERSTRUCTURES

[75] Inventor: Edward D. Dysarz, Houston, Tex.

[73] Assignee: Dynovation Design and Engineering Inc., Houston, Tex.

[21] Appl. No.: 887,536

[22] Filed: Jul. 21, 1986

[51] Int. Cl.[4] ..... B63B 3/02

[52] U.S. Cl. ..... 114/32; 114/264; 114/260; 405/209

[58] Field of Search ..... 114/258, 259, 260, 29, 114/31, 32, 33, 264, 265; 405/195, 196, 197, 199, 200, 201, 202, 203, 204, 205, 206, 207, 208, 209

[56] References Cited

U.S. PATENT DOCUMENTS 3,054,267 9/1962 Alcorn et al. ..... 114/32

4,651,667 3/1987 de Boer et al. ..... 114/32

*Primary Examiner*—Sherman D. Basinger

*Assistant Examiner*—Edwin L. Swinehart

[57] ABSTRACT

A method and apparatus for transporting a marine superstructure on a vessel floating in a body of water to a working site, placing the semi submersible part of the apparatus into a body of water, lowering the semi submersible into a stable position, moving the marine superstructure from the vessel and onto the semi submersible, elevating the semi submersible with the marine superstructure over the marine structure, lowering the semi submersible vessel and marine superstructure, causing the marine superstructure to rest on the marine structure, pulling the semi submersible away from the marine structure and marine superstructure and placing the semi submersible back onto the vessel. To remove the marine superstructure from the marine structure and place the marine superstructure onto the vessel the same method is used in reverse.

21 Claims, 17 Drawing Sheets

SEMI SUBMERSIBLE DEVICE AND METHOD TO SET AND SALVAGE MARINE SUPERSTRUCTURES

BACKGROUND OF INVENTION

1. Field of the Invention

The present invention relates to an offshore marine construction method and apparatus for transporting and erecting marine superstructures on marine structures within a body of water such as for example, a river, lake, sea or ocean.

More particularly the invention relates to an improved and efficient method of setting large marine superstructures on marine structures or offshore towers. The marine superstructure in most cases would be used as a platform to support a drilling apparatus or a petroleum production plant. The marine superstructure could also be a platform to support a radar or sonar devise, a helicopter refueling station, a pumping station or a light house.

This invention is also an improved and efficient method of removing marine superstructures from marine structures and transporting the marine superstructure to shore.

2. Description of Prior Art

A derrick barge or crane ship is a well used tool for assisting in the construction of marine structures and superstructures. However, its lifting ability is limited by the height of the superstructure to be lifted, and the horizontal distance from the derrick to the center of the superstructure combined with the weight of the superstructure.

As the weight, size and height of the marine superstructure is increased, the size of the derrick must be increased at an exponential rate, or the marine superstructure must be fabricated in sections and assembled offshore; either solution is very expensive.

To increase the weight lifting ability of a derrick barge, the boom must be made heavier, the cables must be a greater diameter and the number of cables must be increased, a more powerful and heavier winch must also be added. With the increased weight of the cables, boom, winch and other machinery added above the main deck of the vessel, the center of gravity is elevated and the vessel may become unstable; to compensate for this instability the size of the vessel will most likely have to be increased. Again the cost of the derrick barge will be increased exponentially.

A major problem with a derrick barge or a crane ship is that when the sea conditions are not calm or near clam, the derrick barge or the crane ship must stop working. The reason why work must stop is that a wave may cause the barge or ship to move only one foot in any direction; that one foot of motion could translate into two or three feet of motion in the derrick itself and two or three feet of motion could translate into eight or ten feet of motion at the end of the boom.

When lifting a heavy marine superstructure any motion at all will add a massive amount of stress to the derrick and could possibly cause it to fail.

The semi submersible derrick vessel is another offshore construction tool for lifting marine structures and marine superstructures.

The semi submersible derrick vessel is a column stabilized vessel with four or more columns and with one, but more often two, large derricks mounted over two of the four columns. This vessel operates in much the same manner as derrick barge or crane ship except that it is affected less by waves.

The semi submersible derrick vessel has the same problems with the derrick as does the derrick barge. To be capable of lifting over the top of a marine structure the boom, cables, winches and other machinery must be quite heavy and therefore increase the cost of the total unit.

Another problem with a semi submersible derrick vessel is that it is towed on two or more pontoons which is difficult and costly; it is also very unstable with the weight of the upper hull and the one or two derricks well over a hundred feet above the pontoons.

A semi submersible derrick vessel is far more expensive than a derrick barge or a crane ship but it has an advantage of being able to work in more sever wave conditions.

Another major problem with any vessel that requires a crane or a derrick is that the lifting must be done from above the marine superstructure. To lift from above, pad eyes must be installed above the structure and the pad eyes must be suitably fastened to the main structure which is usually the lower part of the marine superstructure.

The most efficient method of lifting an object is to grasp the object from underneath. To lift a table, chair, desk, refrigerator, automobile or most other objects the most common, efficient and time proven method is to lift from under the object. Derrick or crane vessels only lift a marine superstructure from above which is inefficient and more expensive.

When using a derrick barge, crane ship or a semi submersible derrick vessel another vessel called a deck cargo barge or a launch barge must also be used to transport the marine superstructure. This second barge will also require the services of at least two tug boats and an anchor laying vessel which will further increase the cost of setting a marine superstructure onto a marine structure.

It would be more desirable to transport a marine superstructure and a small semi submersible vessel on a single barge hull. Additionally, it would be an advantage to lift a marine superstructure from underneath on its main beams. Further, it would be a greater advantage to be capable of lifting a greater load at a lower cost.

Several types of lifting devices have been known and used before and typical examples thereof are shown in U.S. Pat. No. 2,592,448 issued Apr. 8, 1952 to W. V. McMenimen; U.S. Pat. No. 2,907,172 issued Oct. 6, 1959 to W. S. Crake; French Pat. No. 1.214.760 E. 21B issued Apr. 12, 1960 to N. V. De Bataafsche; U.S. Pat. No. 2,959,015 issued Nov. 8, 1960 to Robert W. Beck; U.S. Pat. No. 3,054,267 issued Sept. 18, 1962 to I. W. Akcorn et al; U.S. Pat. No. 3,183,676 issued May 18, 1965 to R. G. LeTourneau; U.S. Pat. No. 3,442,340 issued May 6, 1969 to L. B. Christenson; U.S. Pat. No. 3,727,414 issued Apr. 17, 1973 to P. Davies; U.S. Pat. No. 4,041,711 issued Aug. 16, 1977 to V. E. Lucas; U.S. Pat. No. 4,045,967 issued Sept. 6, 1977 to J. F. Schirtzinger; U.S. Pat. No. 4,224,005 issued Sept. 23, 1980 to E. D. Dysarz U.S. Pat. No. 4,651,667 issued Mar. 24, 1987 to de Boer et al. None of these devices, however, teach the transportation of a semi submersible and a marine superstructure on a single barge, the placing of the marine superstructure onto the semi submersible vessel, further elevating the semi submersible vessel while efficiently supporting the marine superstructure underneath and further setting the marine superstructure on a marine structure.

SUMMARY OF THE INVENTION

The present invention is a highly effective system and method that will enable large marine superstructures to be set on marine structures or removed from marine structures in a more efficient manner and at a lower cost than present methods used.

It is a particular object of the invention to provide a method to transport a marine superstructure on the same vessel that sets the marine superstructure on the marine structure.

It is further an object of this invention to be capable of lifting a marine superstructure from underneath the marine superstructure.

It is still further an object of this invention to reduce the hazards to personnel and equipment while setting a marine superstructure on a marine structure.

It is another object of this invention to be capable of lifting more weight for less cost.

It is still another object of this invention to minimize the stress put on a marine superstructure as it is being set on a marine structure.

It is yet another object of this invention to eliminate most offshore assembly labor and further reduce the hook up time required to assemble a marine superstructure and all of its components, by lifting and setting a completely assembled marine superstructure onto a marine structure.

THE DRAWINGS

For further understanding of the nature and objects of the present invention, reference should be had to the following detailed description of the preferred embodiments thereof, taken in conjunction with the accompanying drawings, in which like parts are given like reference numerals and wherein.

DETAILED DESCRIPTION OF THE PREFERRED EMBODIMENT

The preferred embodiment of the device and method of the present invention may be used to set and salvage marine superstructures that weigh from several tons to more than ten thousand (10,000) tons.

The great lifting capacity is accomplished by the use of two or more lifting arms supported by and suitably attached to one or more semi submersible (also called column stabilized) vessels that is balanced and partially supported by a conventional vessel such as a barge or ship.

A particularly important application of the present invention is in the setting of a marine superstructure onto a marine structure or the removal of a marine superstructure from a marine structure. It should be realized that the present invention could be applied to any application where it is desired to set or remove heavy objects that are to be placed onto or removed from a marine structure, for example, the setting of a bridge structure on caissons or the removal of a bridge structure from caissons.

The preferred embodiment and the other embodiments place more emphasis on the setting of a marine superstructure onto a marine structure but it is equally capable of removing a marine superstructure from a marine structure.

The vessel of the device of the preferred embodiment is assisted by a tug boat but it may be self propelled.

Device and Its Method of Use

Figure 1:
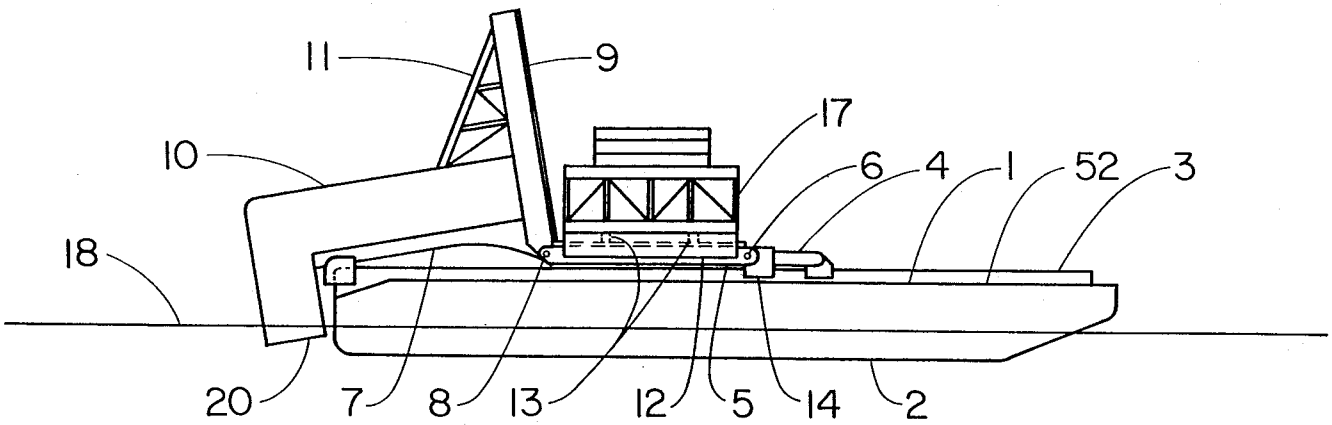
FIG. 1 is an elevation view of embodiment 1 of the present invention showing the launch barge bearing a marine superstructure and a semi submersible vessel in a horizontal position.

Referring to FIG. 1 there is shown an elevation of the preferred embodiment. The device 1 is composed of the following: a vessel 2 that is floating on the sea surface 18; on the vessel 2 is a deck 52 with one or more launch rails 3 mounted on the deck 52 parallel to the longitudinal axis of the vessel 2; a gripper jack 4 is mounted on each launch rail 3 and will propel the carriage 14 along the launch rails 3; the carriage 14 is attached to the pullback beam 5 by a carriage pin 6; at the other end of the pullback beam 5 is the lifting beam 9 and the curved guide frame 7; the lifting beam 9 and the curved guide frame 7 are connected to the pullback beam 5 by a hinge pin 8; the curved guide frame 7 and the lifting beam 9 are also suitably attached to the semi submersible vessel 10; at the other end of the semi submersible vessel 10 is a sponson tank 20 that aids in the launching and retrieving of the semi submersible vessel 10; on the semi submersible vessel 10 there is also a truss 11 that supports the lifting beam 9; on the pullback beam 5 there is also shown the marine superstructure carriage 12 that supports the marine superstructure 17 on shock pads 13.

Figure 2:
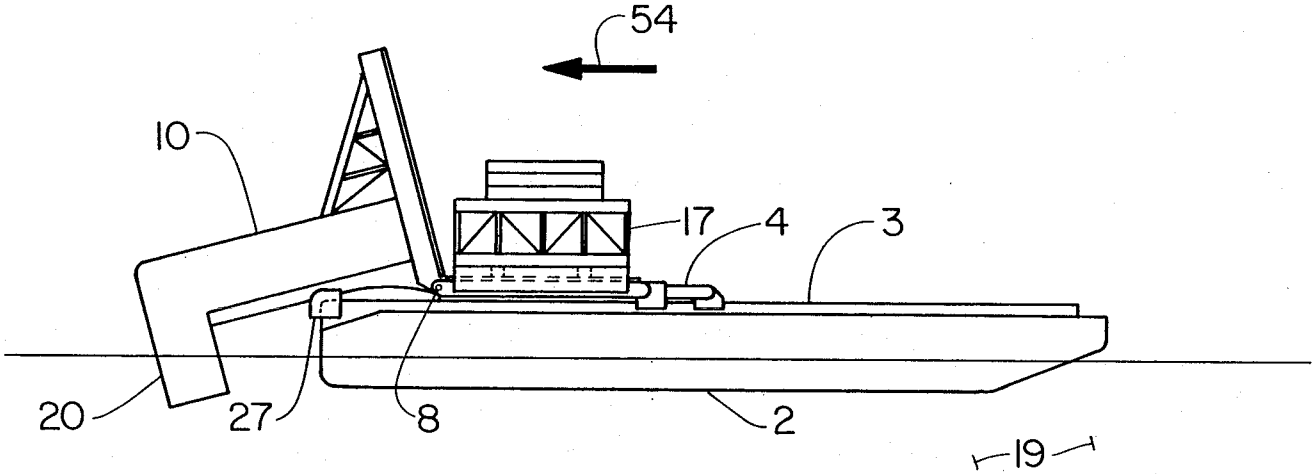
FIG. 2 is an elevation view of the present invention showing the launch barge bearing a marine superstructure and launching the semi submersible vessel.

Referring to FIG. 2 there is shown the semi submersible vessel 10 being pushed off of the vessel 2.

The gripper jacks 4 push on the carriage 14 which push on the pullback beam 5 which push on the curved guide frame 7 and cause the semi submersible vessel 10 to move in an aft direction 54. As the semi submersible vessel 10 is being pushed into the sea 19 the sponson tank 20 supports some of the weight of the semi submersible vessel 10. The guide unit 27 also holds the semi submersible vessel 10 in place as the semi submersible vessel 10 is being pushed off of the vessel 2 and the launch beams 3.

As the gripper jacks 4 push the semi submersible vessel 10 into the sea 19 the marine superstructure 17 is also pushed in an aft direction 54.

Figure 3:
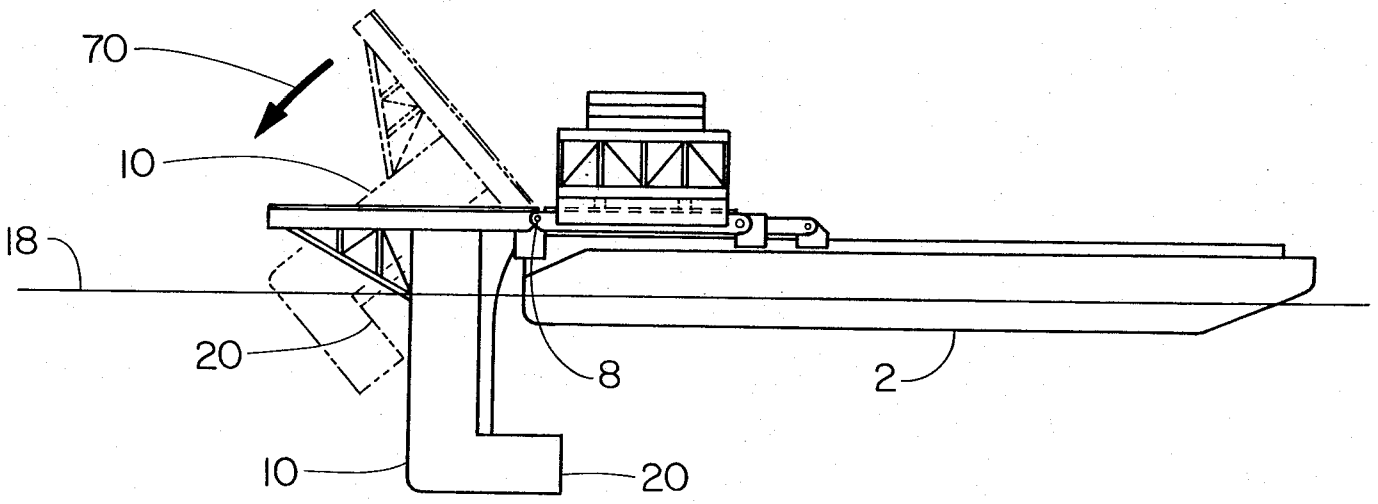
FIG. 3 is an elevation view of the present invention showing the launch barge bearing a marine superstructure with the semi submersible vessel in a vertical position.

Referring to FIG. 3 there is shown the semi submersible vessel 10 launched from the vessel 2 into the sea 19.

When the semi submersible vessel 10 is pushed completely off of the vessel 2 the sponson tank 20 is flooded with water, causing the semi submersible vessel 10 to rotate in a counter clockwise direction 70 around hinge pin 8.

Figure 4:
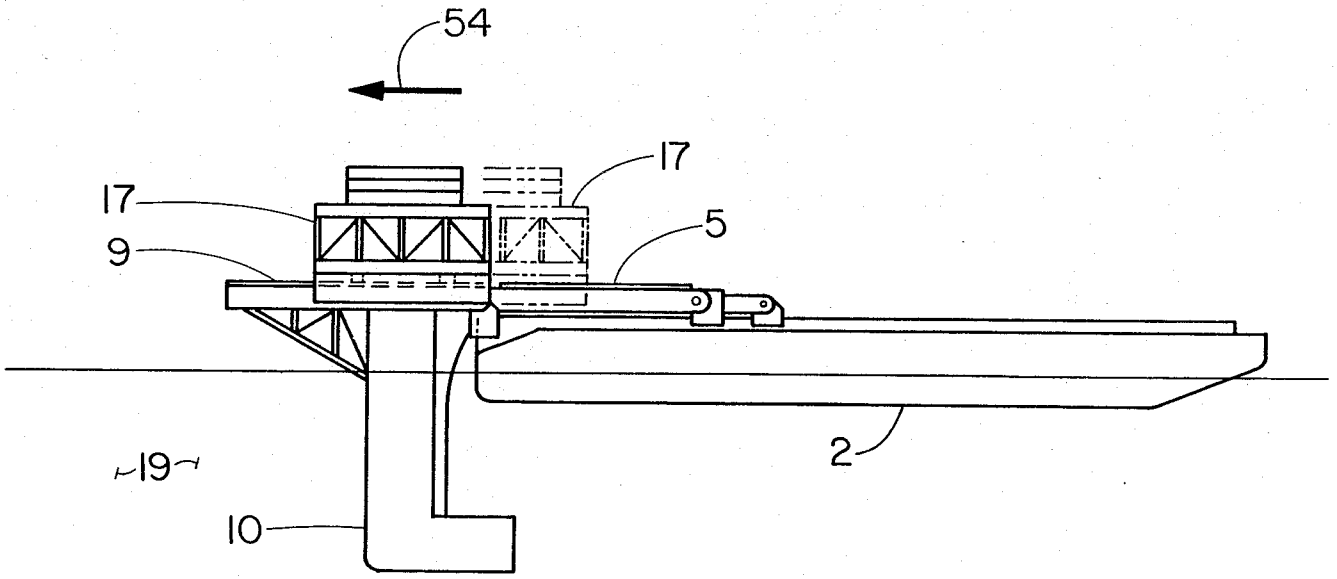
FIG. 4 is an elevation view of the present invention showing the launch barge and the marine superstructure being supported by the semi submersible vessel.

Referring to FIG. 4 there is shown the semi submersible vessel 10 lowered into the sea 19 to a suitable height relative to the vessel 2. The semi submersible vessel 10 is now in a vertical position and the marine superstructure 17 can be moved off of the vessel 2 and onto the semi submersible vessel 10.

The marine superstructure 17 is moved from the vessel 2 to the semi submersible vessel 10 in an aft direction 54 by a marine superstructure gripper jacks 56 not shown in this view. The marine superstructure 17 is supported on the marine superstructure carriage 12 and the shock pads 13 as it is moved from the pullback beam 5 on the vessel 2 to the lifting beam 9 on the semi submersible vessel 10.

Figure 5:
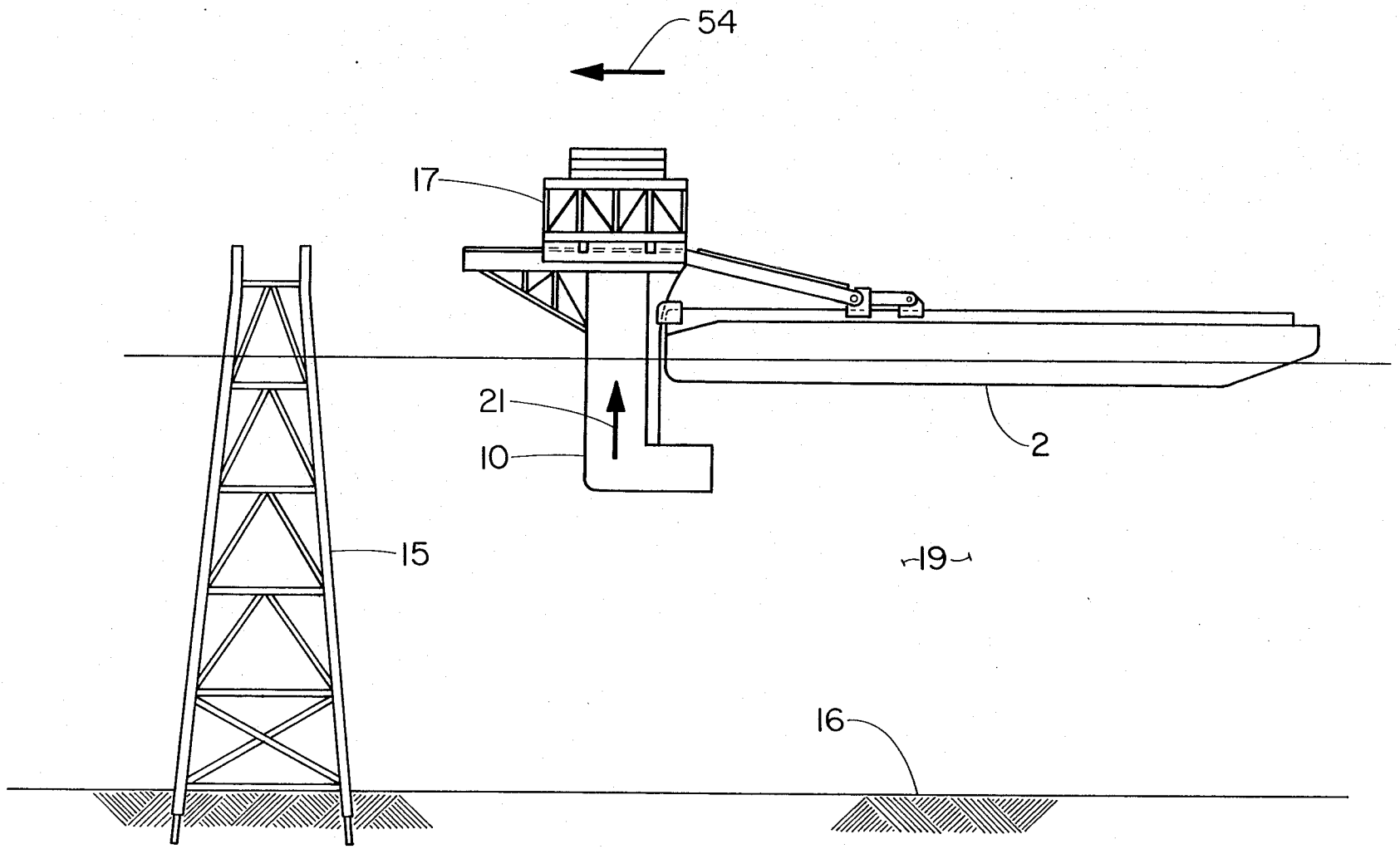
FIG. 5 is an elevation view of the present invention showing the launch barge with the semi submersible vessel elevating the marine superstructure.

Referring to FIG. 5 there is shown the semi submersible vessel 10 as it is being moved in an aft direction 54 toward the marine structure 15 that is setting on the sea floor 16. The semi submersible vessel 10 is being pushed by the vessel 2. The vessel is being moved by pulling on anchors with anchor winches not shown or it could be moved by tug boats not shown, it could also be moved by its own propulsion system also not shown.

As the semi submersible vessel 10 is being moved toward the marine structure 15 the semi submersible vessel 10 is also being moved in an upward vertical direction 21 by pumping air into or water out of the semi submersible vessel 10. The air is pumped into or water is pumped out of the semi submersible vessel 10 by pumps not shown through valves and pipes not shown that could be located on the vessel 2 or the semi submersible vessel 10.

Figure 6:
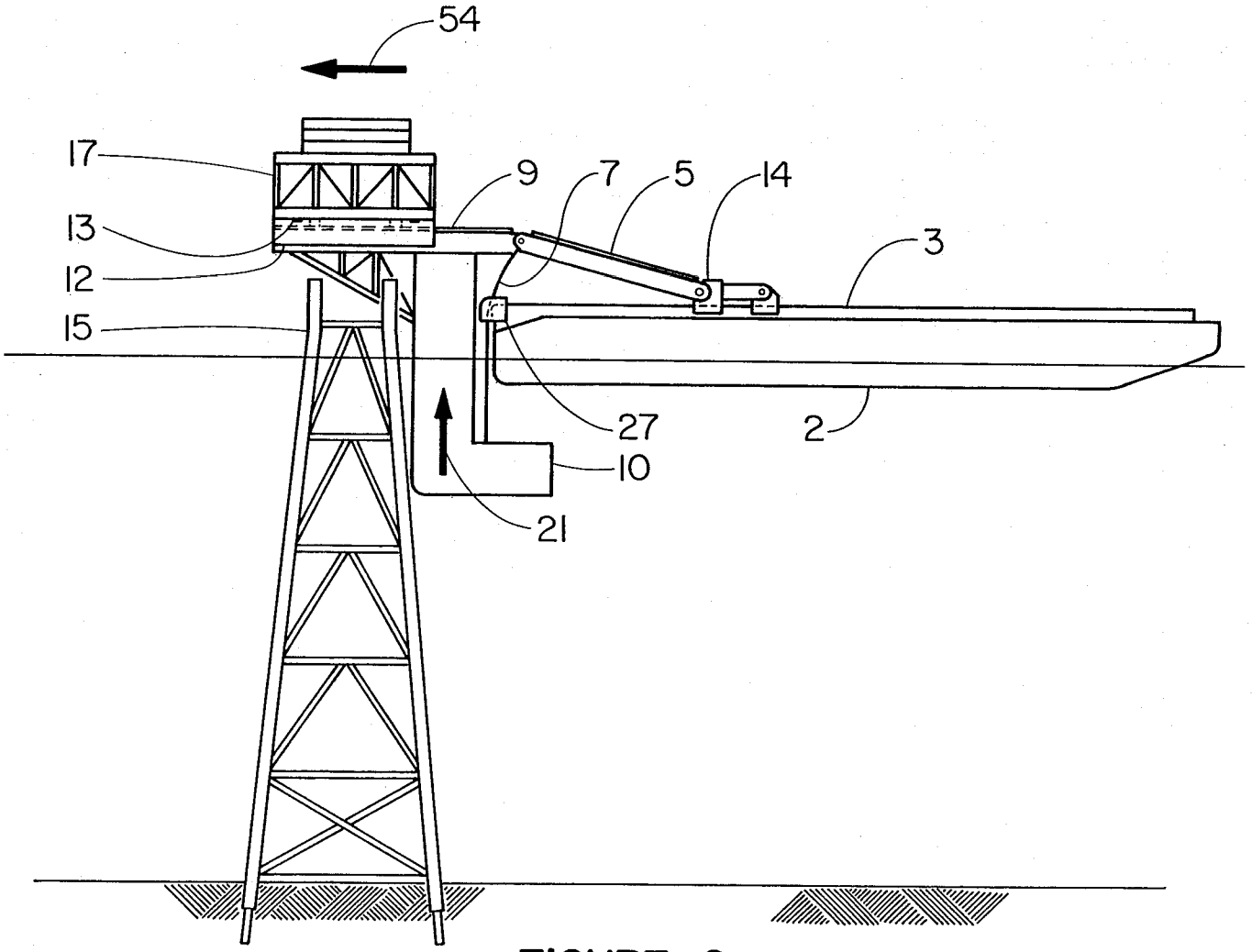
FIG. 6 is an elevation view of the present invention showing the launch barge with the semi submersible vessel elevating the marine superstructure over a marine structure.

Referring to FIG. 6 there is shown the marine superstructure 17 elevated over the marine structure 15.

More air has been pumped into the semi submersible vessel 10 causing it to move further in an upward vertical direction 21. The marine superstructure 17 has also been moved further in an aft direction 54 on the marine superstructure carriage 12 moving on the lifting beam 9. The shock pads 13 are also supporting the marine superstructure 17 on the marine superstructure carriage 12.

As the marine superstructure 17 is being elevated, the pullback beam 5 is pulling on the lifting beam 9 and the curved guide frame 7 is pushing on the guide unit 27 to prevent the semi submersible vessel from rotating in a counter clockwise direction. The method of pulling on the pullback beam 5 at the carriage 14 and launch rail 3 will be explained and detailed in FIGS. 12, 13, 20 and 21.

Figure 7:
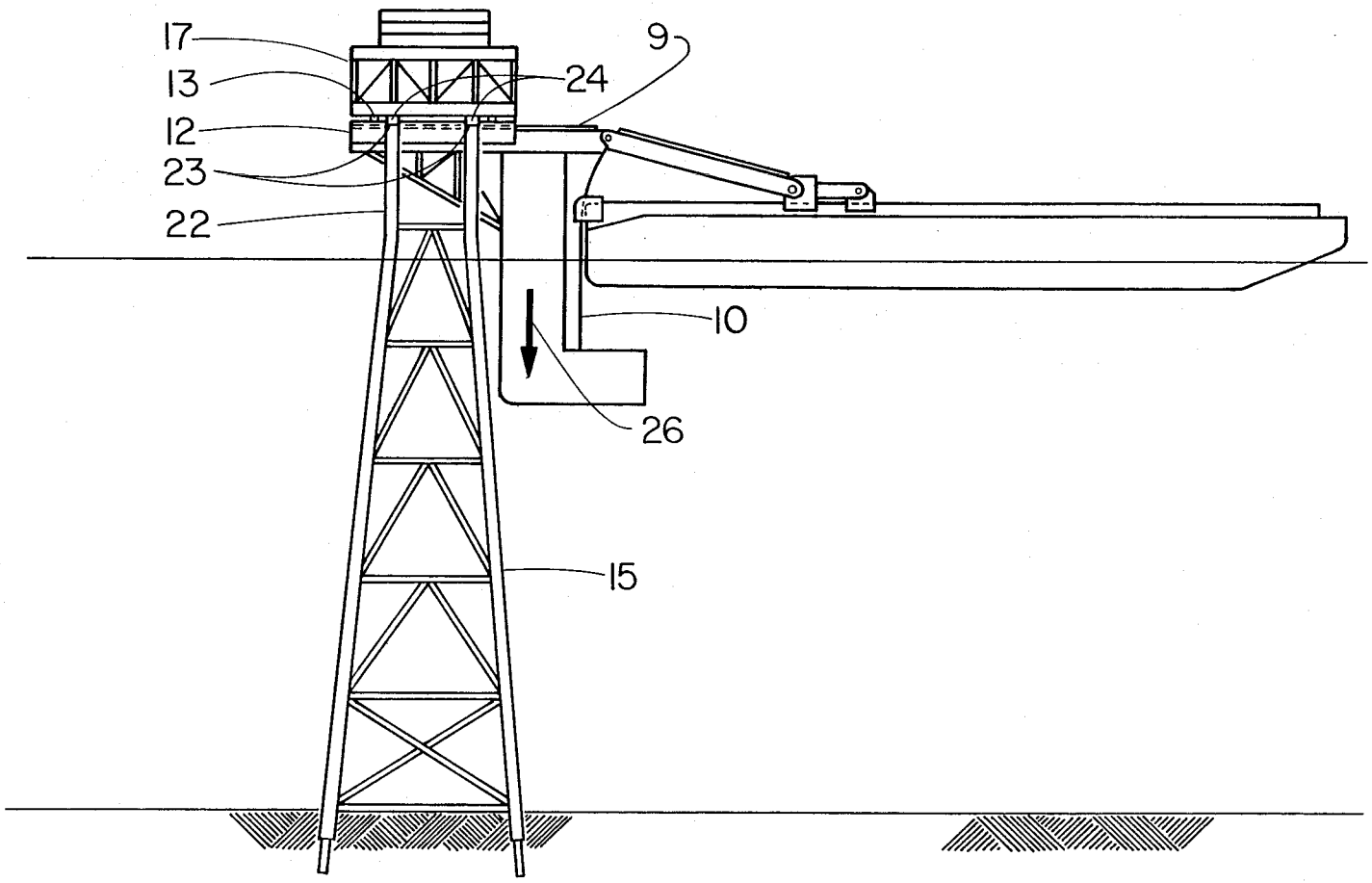
FIG. 7 is an elevation view of the present invention showing the launch barge with the semi submersible vessel lowering the marine superstructure onto the marine structure.

Referring to FIG. 7 there is shown the marine superstructure 17 after it has been lowered onto the vertical legs 22 of the marine structure 15.

The semi submersible vessel 10 is partially flooded with water causing it to move in a downward vertical direction 26. As the marine superstructure 17 also moves in a downward vertical direction, the leg stubs 24 that are suitably attached to the bottom of the marine superstructure 17, butt into the vertical legs 22 of the marine structure 15 at the butt line 23. The leg stubs 24 may be of any length or they may be eliminated entirely by lowering the bottom section of the marine superstructure 17 directly onto the vertical legs 22 of the marine structure 15.

As the marine superstructure 17 is being lowered, the semi submersible vessel 10 may move some in a sea wave. To prevent damage from the marine superstructure carriage 12 or the lifting beam 9 striking the lower portion of the marine superstructure, shock pads 13 are placed between the marine superstructure 17 and the marine superstructure carriage 12. The shock pads 13 are rubber pads or pads made up of other soft material that will absorb the energy from the motion of the semi submersible vessel before the lifting beams 9 strike the marine superstructure 17. Other means could be used to absorb the energy such as springs, timber or hydraulic shock absorbers.

Figure 8:
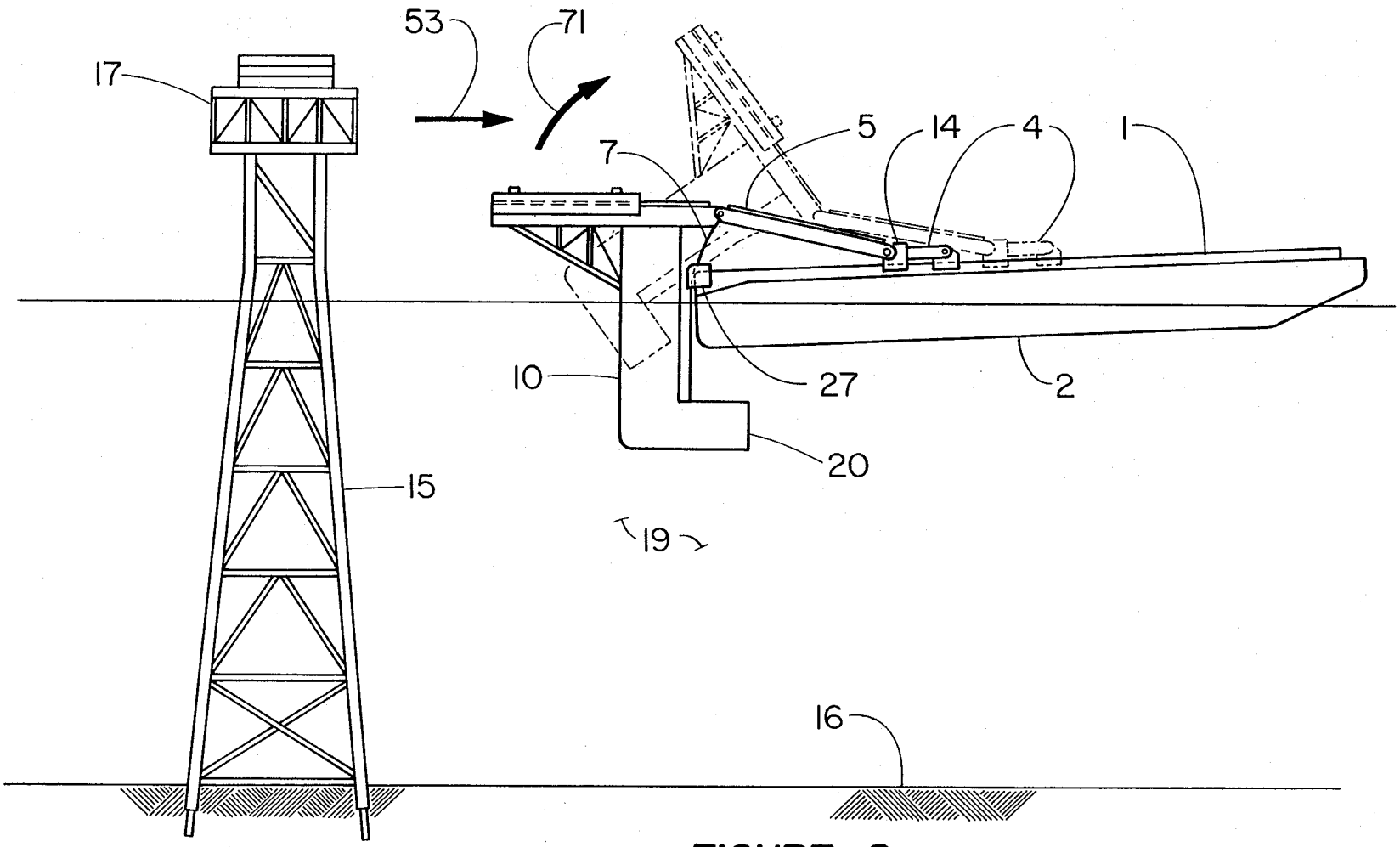
FIG. 8 is an elevation view of the present invention showing the launch barge with the semi submersible vessel withdrawing from the marine superstructure resting on the marine structure.

Referring to FIG. 8 there is shown the device 1 withdrawn from the marine superstructure 17 now resting on the marine structure 15 which is resting on the sea floor 16.

The vessel 2 has been pulled away in a forward direction 53 by pulling on the anchor lines with the anchor winches not shown or by being pulled by tug boats also not shown. When the vessel 2 is pulled away from the marine structure 15 and the marine superstructure 17 the semi submersible vessel 10 is also withdrawn.

As the device 1 is being withdrawn, air is pumped into or water is pumped out of the semi submersible vessel 10 allowing the semi submersible vessel 10 to move in an upward vertical direction 21 again. When the semi submersible vessel 10 has been elevated to the desired height, the gripper jack 4 starts to pull on the carriage 14 which pulls on the pullback beam 5 which pulls the marine superstructure 10 over in a clockwise direction 71. As the semi submersible vessel 10 is pulled over it will rest on the sponson tank 20 that is now buoyant in the sea 19 and the curved guide frame 7 that is resting on the guide unit 27.

Figure 9:
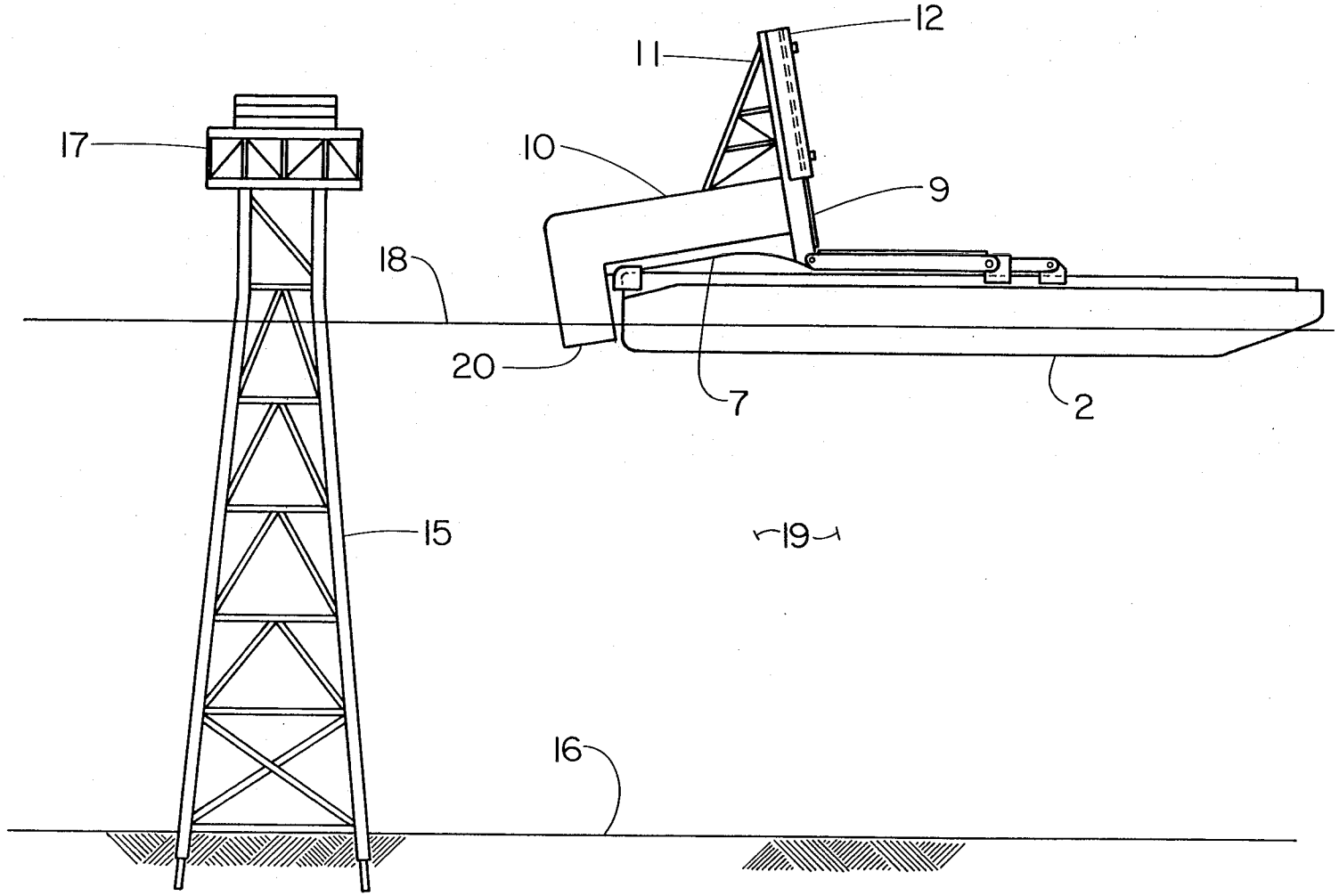
FIG. 9 is an elevation view of embodiment 1 of the present invention showing the semi submersible vessel resting in a horizontal position on the launch barge and being withdrawn from the marine superstructure that is resting on the marine structure.

Referring to FIG. 9 there is shown another elevation of the preferred embodiment.

The marine superstructure 17 is shown resting on the marine structure 15 which is resting on the sea floor 16.

The device 1 has been withdrawn from the marine superstructure 17. The semi submersible vessel 10 has been pulled up onto the vessel 2. The semi submersible vessel 10 is now in a substantially horizontal position on the vessel 2 and it is resting on the curved guide rail 7 and the buoyancy from the sponson tank 20. The lifting beam 9 and the truss 11 are in a vertical position above the vessel 2.

To remove the marine superstructure 17 from the marine structure 15 the opposite of FIG. 1 thru FIG. 9 would occur. FIG. 1 would be FIG. 9 and so on until FIG. 9 would become FIG. 1.

Figure 10:
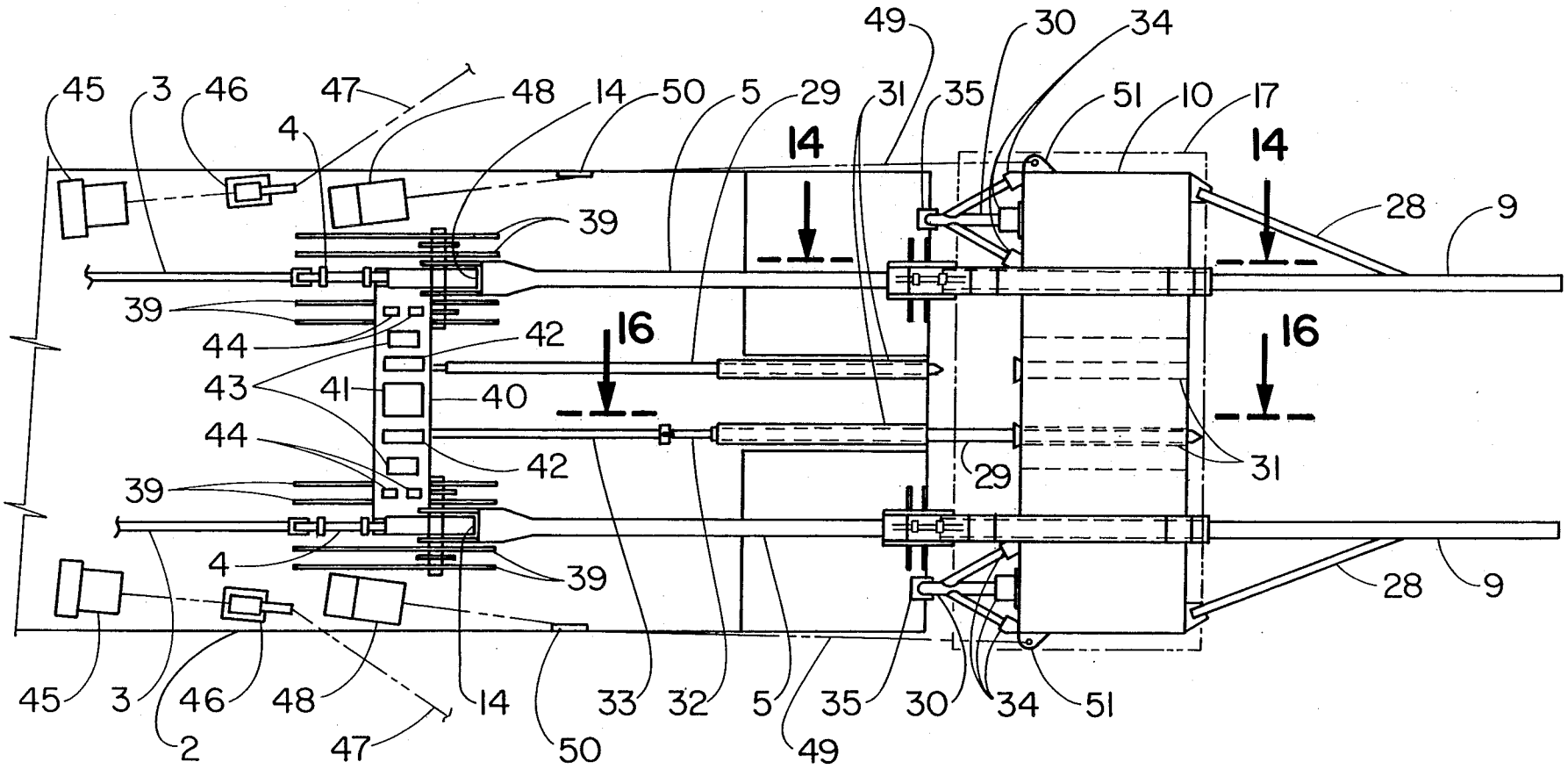
FIG. 10 is a plan view of the present invention showing the top of the launch barge and the semi submersible vessel.

Referring to FIG. 10 there is shown a plan view of the vessel 2 and the semi submersible vessel 10 with all of the necessary components required to recover a marine superstructure 17.

The marine superstructure 17 is outlined and it is shown resting on the lifting beams 9. The marine superstructure 17 is also shown over the semi submersible vessel 10.

The lifting beams 9 are shown being laterally supported by a diagonal brace 28. The diagonal braces 28 may be installed on the inboard side of the lifting beams 9 if there are any obstacles from the marine structure 15 or marine superstructure 17 that would interfere with the diagonal braces 28 on the outboard side. The diagonal braces 28, the lifting beams 9 and the truss 11 not shown in this view, may be moved inboard or outboard from their shown location if the particular structure of the marine superstructure 17 or the marine structure 15 require.

When the marine superstructure 17 is being moved from the semi submersible vessel 10 to the vessel 2 there should be a rigid connection between the two units thus causing both vessels to move in the water as one. To accomplish this monolithic rigidity, a stabilization beam 29 and a holdback frame 30 are placed on each side of the vessel 2 and the semi submersible vessel 10.

The stabilization beam 29 is a structural box beam in section or it could be a conventional wide flange or any other structural shape that is extended from the vessel 2 to the semi submersible vessel 10 and held in place on each vessel by a suitable structural tunnel 31. Each structural tunnel 31 is suitably reinforced and attached to the vessel 2 and the semi submersible vessel 10 to prevent any vertical or lateral movement of one vessel relative to the other vessel.

The stabilization beam 29 is pushed to extend from the structural tunnel 31 on the vessel 2 and insertion into the structural tunnel 31 on the semi submersible vessel 10 or withdrawn from the structural tunnel 31 of the semi submersible vessel 10 by means of a stabilization beam gripper jack 32 that is located on the vessel 2. The stabilization beam gripper jack 32 could also be located on the semi submersible vessel 10 by design choice. The stabilization beams could also be located on each side of the vessels by design choice.

The stabilization beam gripper jacks 32 are hydraulic cylinders that are suitably attached to grippers that temporarily grip or hold onto a rail 33 while the hydraulic cylinder expands and pushes or pulls a load; gripper jacks are common in the art of moving loads.

The stabilization beams 29 could also be moved by a rack and pinion system or by a cable and winch system not shown.

The holdback frame 30 is a frame that prevents the semi submersible vessel 10 from rotating under the vessel 2. Further, when the semi submersible vessel 10 is being lowered, the holdback frame 30 will stop the semi submersible vessel 10 from descending past a predetermined elevation.

The holdback frame 30 has three load cells 34 that are made up of cylinders filled with rubber or other similar cushioning material. The structural frame is inserted into the rubber. When the holdback frame 30 touches the vessel 2, the load cells 34 absorb the energy of the vessel 2 and prevent damage. Load cells 34 are common in the art of cushioning a blow or absorbing energy.

At the end of the holdback frame 30 is a lip 35 that is fabricated to suit the shape of the vessel 2 where the holdback frame 30 will strike the vessel 2. The holdback frame 30 could also be fastened to the vessel 2 to restrain the semi submersible vessel 10; this would be a matter of design choice.

The pullback beams 5 restrain and balance the semi submersible vessel 10 as it is elevated or lowered. Each pullback beam 5 is independent of the other pullback beam 5. This independent support allows the vessel 2 to roll while the semi submersible vessel 10 will remain stable and at the same time remain balanced and restrained in a fore and aft direction.

The pullback beams 5 are anchored to the carriage 14 which is also anchored to the anchor plates 39 in the vessel 2. This will be further explained in FIGS. 12 and 13.

The carriage 14 is pushed or pulled along the launch rails 3 by gripper jacks 4. The carriage 14 could also be moved in a forward or aft direction on the vessel 2 by means of a rack and pinion system or a cable and winch system not shown. The method of locomotion is a design choice.

Connecting the two carriages 14 is a bridge platform 40 that supports the control house 41, generators 42, compressors 43, pumps 44 and other components necessary to enable this system to operate.

Also shown in FIG. 10 are the mooring winches 45, fairleaders 46 and anchor lines 47. The guide winches 48 are used to pull the bottom section of the semi submersible vessel 10 up to the vessel 2 and to hold it firmly in place in a subsea current. The guide winch 48 pulls on the guide line 49 that runs through a closed chock 50 and is suitably attached to the pad eye 51 on the semi submersible vessel 2.

Figure 11:
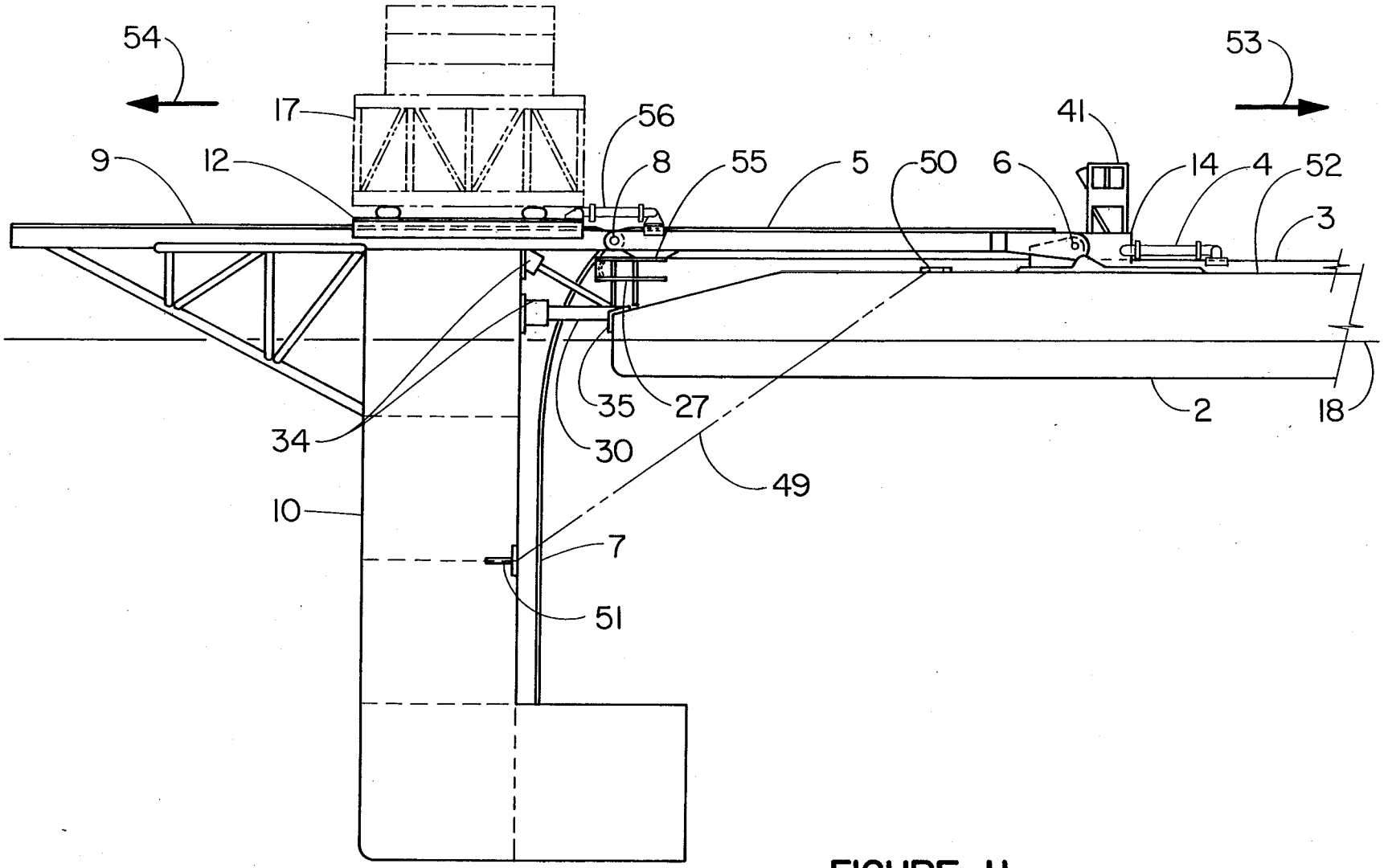
FIG. 11 is an enlarged elevation of the semi submersible vessel and part of the launch barge.

Referring to FIG. 11 there is shown an elevation of the preferred embodiment. Part of vessel 2 is shown floating on the sea surface 18.

On vessel 2 there is shown a launch rail 3 that is suitably fastened to the deck 52 of vessel 2. On the launch rail 3 is carriage 14 that is moved in a forward direction 53 and aft direction 54 relative to vessel 2 by a gripper jack 4.

Suitably connected to the carriage 14 is a pullback beam 5 that is shown connected to the curved guide frame 7 and lifting beam 9 by hinge pin 8. The pullback beam 5 is in a horizontal position.

When the pullback beams 5 are in a horizontal position, one end of each pullback beam is resting on the carriage pin 6 and the other end is resting on the skid pad 55. The skid pad 55 is a plate that is suitably attached to the bottom aft end of the pullback beam 5. As the pullback beam is moved in a forward direction 53 and aft direction 54 as shown in FIGS. 1, 2, 8 and 9 the skid pad 55 will ride and rub on the launch rail 3 and act as a bearing. Although the skid pad 55 is shown here as a plate, it also could be a set of rollers, or a set of brushes and it could also be located on the launch rails 3 by design choice.

The control house 41 is shown above the carriage 14. The mooring winch 45, the fairleader 46 and the guide winch 48 are not shown for clarity.

The marine superstructure 17 is shown resting on the marine superstructure carriage 12 which is resting on the lifting beams 9. The marine superstructure 17 is being moved in an aft direction 54 by the marine superstructure gripper jacks 56. The marine superstructure 17 has just beem moved off of the vessel 2 and onto the semi submersible vessel 10 by the marine superstructure gripper jacks 56. Other types of systems could be used to move the marine superstructure 17 such as chain jacks, rack and pinion jacks and winch and cable systems. It would be a matter design choice to utilize any of the above mentioned systems.

The curved guide frame 7 is shown held in place by the guide unit 27. Also shown is the holdback frame 30 and the load cells 34. The holdback frame 30 is pushing on a corner of the vessel 2 with a lip 35.

The guide line 49 is shown passing through the closed chock 50 suitably attached to the vessel 2. The guide line 49 is shown suitably attached to a pad eye 51 that is also suitably attached to the semi submersible vessel 10.

Figure 12:
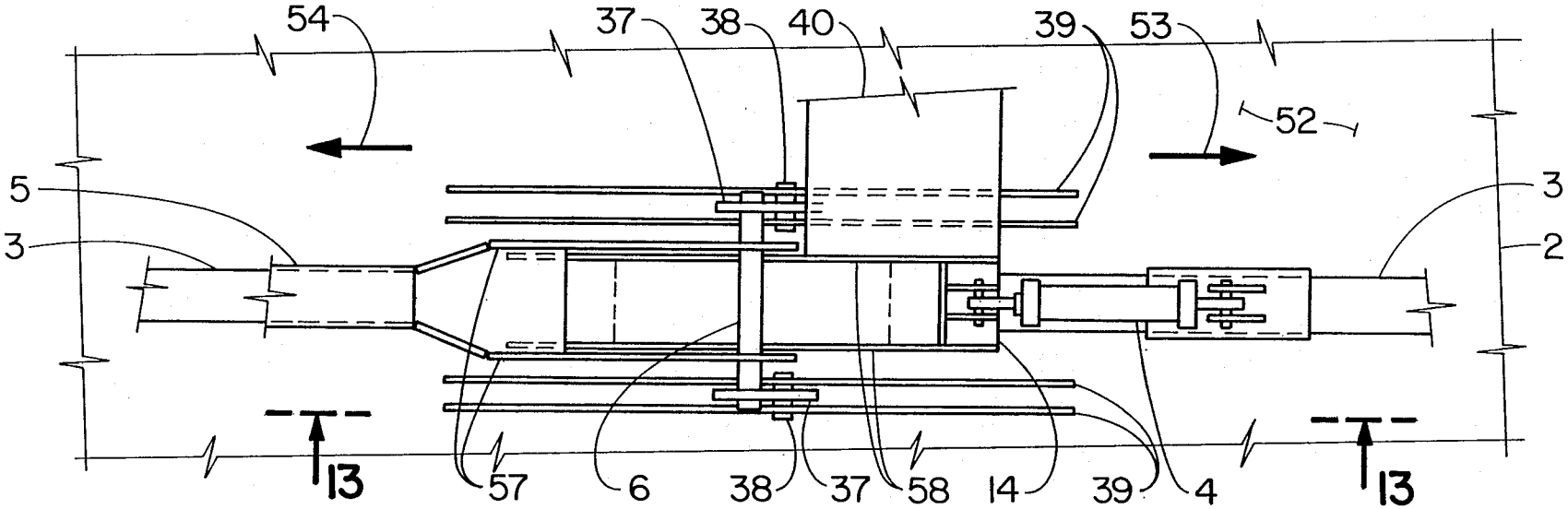
FIG. 12 is an enlarged plan view of the pullback beam anchoring means.

Referring to FIG. 12 there is shown an enlarged detail of the anchoring means for the pullback beam 5.

The pullback beam 5 is suitably attached to the carriage pin 6. The carriage pin 6 is passed through a hole cut in each side plate 57 of the pullback beam 5. The carriage pin 6 is also passed through the carriage side plates 58 on each side of the carriage 14.

Also suitably attached to the carriage pin 6 is the pullback hook 37. The carriage pin 6 passes through a hole in the pullback hook 37 and allows the pullback hook 37 to rotate freely about carriage pin 6.

Shown in parallel lines with the carriage side plates 58 are the anchor plates 39. The anchor plates 39 are firmly attached to structural members of the deck 52 of the vessel 2. The anchor plates 39 could penetrate the deck 52 where they would be suitably fastened to structural members below the deck 52. An anchor pin 38 is passed through a hole in each anchor plate 39 and is further suitably attached to each of said anchor plates 39.

As the carriage 14 is moved on the launch rail 3 in an aft direction 54, the pullback hook 37 is pulled between a pair of anchor plates 39 where the pullback hook 37 catches and further engages the anchor pin 38. To disengage the anchor pin 38 the carriage 14 is moved in a forward direction 53 and the pullback hook 37 merely drops off of the anchor pin 38.

The purpose of the pullback hook 37 is to allow the pullback beam 5 to have a severe tensional force applied from the lifting beam 9 and semi submersible vessel 2 as a marine superstructure 17 is in an elevated position, and transmitting that tensional force from the pullback beam 5 into the pullback hook 37, and further into the anchor pin 38 and still further into the anchor plates 39 and into the vessel 2. The tension caused by the lifting of the marine superstructure 17 could be transmitted into the launch rails 3 and further transmitted into the vessel 2 through the launch rails 3; this would be a matter of design choice.

Also shown in FIG. 12 is a gripper jack 4 suitably fastened to the carriage 14 and also resting on the launch rail 3. The bridge platform 40 is also shown supported on one side by the carriage 14.

Figure 13:
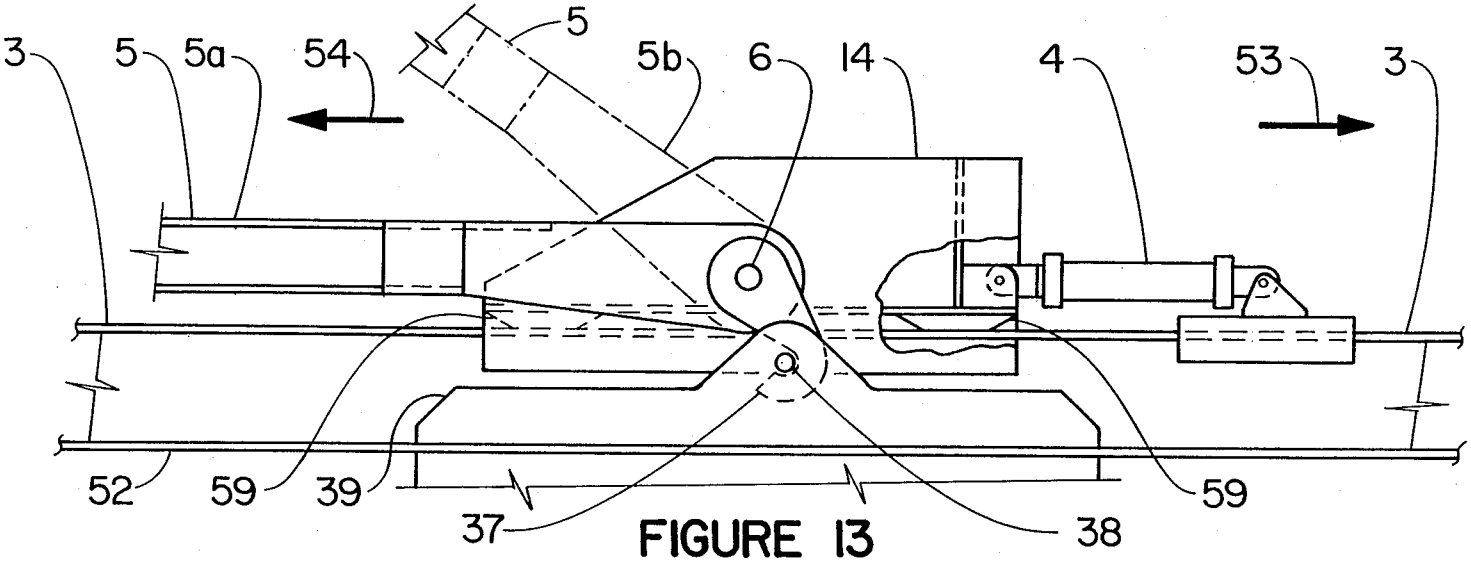
FIG. 13 is an elevation view of the pullback beam and anchoring means.

Referring to FIG. 13 there is shown a sectional elevation of the carriage 14 on the launch rail 3 taken through FIG. 12.

The pullback beam 5 is shown in a horizontal position 5*a* and a diagonal position 5*b*. The horizontal position 5*a* is shown in FIGS. 1, 2, 3, 4 and 9 while the diagonal position 5*b* is shown in FIGS. 5, 6, 7, and 8. FIG. 6 however best describes why the pullback beam 5*b* requires an anchoring device and pullback device as shown in FIGS. 12 and 13.

As the marine superstructure 17 is being elevated on the lifting beams 9 and the semi submersible vessel 10, the mass of the marine superstructure 17 will cause the semi submersible vessel 10 to rotate in a counter clockwise direction.

To prevent this counter clockwise rotation, the pullback beam 5 will pull on the semi submersible vessel 10 at one end of the pullback beam 5. At the other end the pullback beam 5 will pull on the carriage pin 6 which will pull on the pullback hook 37 which will, pull on the anchor pin 38 which will pull on the anchor plates 39 which will pull on the deck 52 of vessel 2.

As the carriage 14 is moved in a forward direction 53 and an aft direction 54 by the gripper jack 4 on the launch rail 3, the carriage 4 is supported on the launch rails 3 by the carriage skid plates 59. Although the carriage skid plates 59 could be steel or bronze wear plates they could also be rollers, bearings, casters or some other devices; this would be a matter of design choice.

Figure 14:
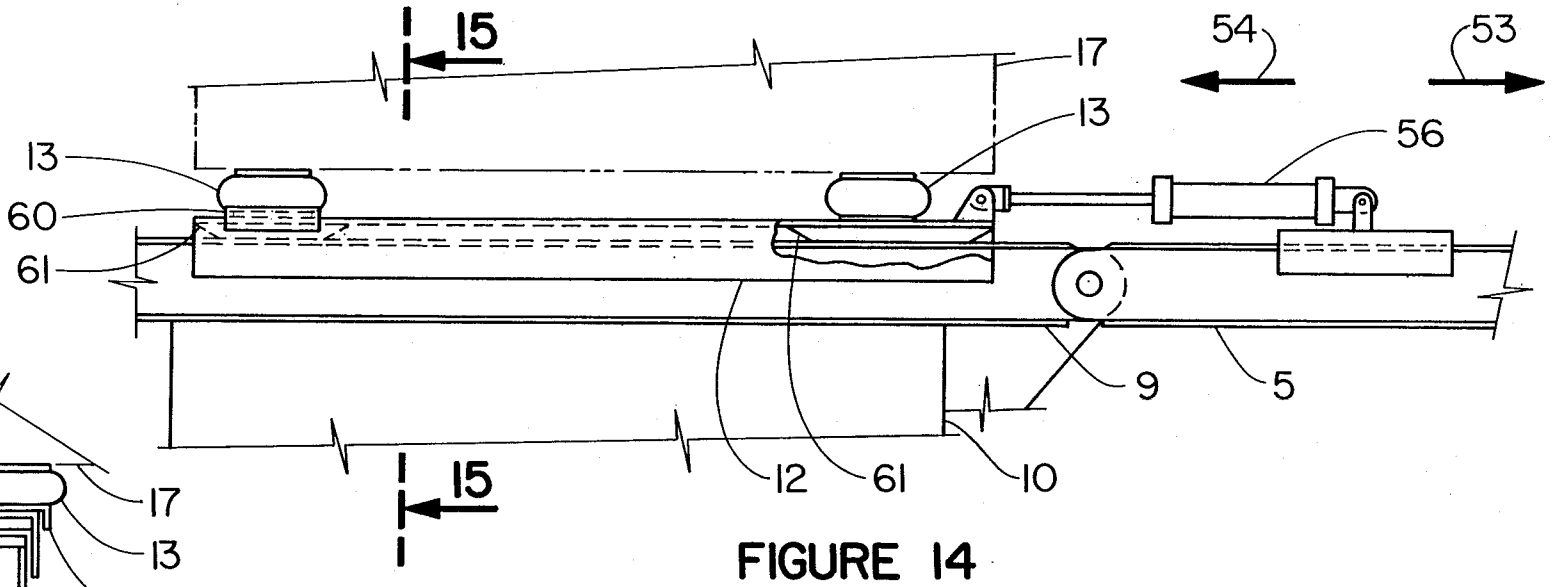
FIG. 14 is a partial section elevation of FIG. 10 of the pullback beam, the lifting beam and the marine superstructure carriage.

Referring to FIG. 14 there is shown an enlarged partial sectional elevation taken through FIG. 10.

An outline of the marine superstructure 17 is shown resting on the shock pads 13. The shock pads 13 are shown supported on the shock pad foundation 60. The shock pad foundation 60 is so constructed that it can be moved horizontally in a forward direction 53 or an aft direction 54 before the marine superstructure 17 is placed on the shock pads 13; the adjustment of the shock pads 13 can be made to suit a particular structure of the marine superstructure 17. The shock pad foundation 60 is suitably attached to the marine superstructure carriage 12 which is in the shape of an inverted U.

The marine superstructure carriage 12 is moved in a forward direction 53 or an aft direction 54 by the marine superstructure gripper jacks 56.

The marine superstructure carriage 12 is supported on one or more marine superstructure carriage skid plates 61 that ride on the top of the lifting beam 9 and the pullback beam 5. The marine superstructure carriage skid plates 61 are made of steel or bronze or some other suitable material which would be a matter of design choice.

The marine superstructure carriage 12 is shown supported on the lifting beam 9 and the semi submersible vessel 10. The marine superstructure gripper jack 56 is shown on the pullback beam 5.

Figure 15:
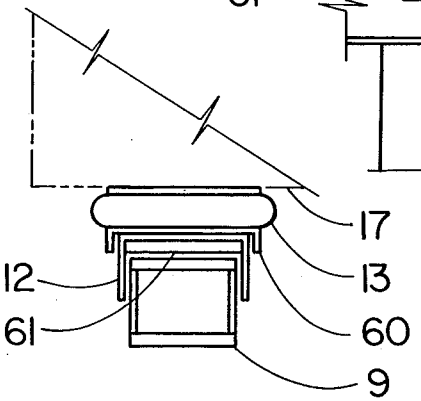
FIG. 15 is a sectional view of the lifting beam and the marine superstructure carriage taken through FIG. 14.

Referring to FIG. 15 there is shown a sectional view taken through FIG. 14.

The marine superstructure 17 is shown supported on a shock pad 13 which is supported on the shock pad foundation 60. The shock pad foundation 60 is shown supported on the marine superstructure carriage 12 which is resting on the marine superstructure carriage skid plate 61 which is supported in this case on the lifting beam 9.

Figure 16:
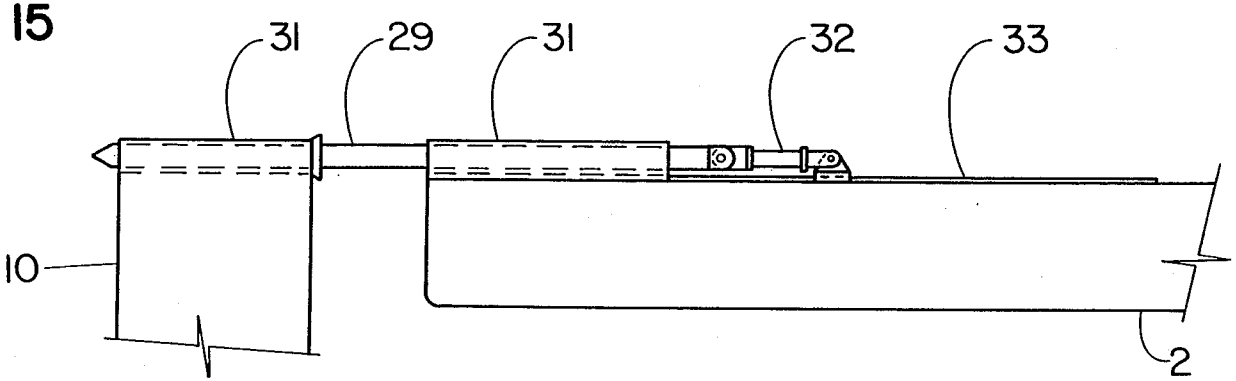
FIG. 16 is a sectional elevation of the stabilization device taken from FIG. 10.

Referring to FIG. 16 there is shown an elevation of the stabilization beam 29 taken through FIG. 10.

The stabilization beam 29 is square or rectangular in section that is shown extended from a structural tunnel 31 in the vessel 2 to a structural tunnel in the semi submersible vessel 10

To extend the stabilization beam 29 from the vessel 2 to the semi submersible vessel 10 a stabilization beam gripper jack 32 pushes the stabilization beam 29 through the structural tunnel 31 on the vessel 2 into the structural tunnel 31 on the semi submersible vessel 10. The stabilization beam gripper jack 32 pushes or pulls the stabilization beam 29 by reacting on rail 33 that is suitably fastened to the vessel 2.

Figure 17:
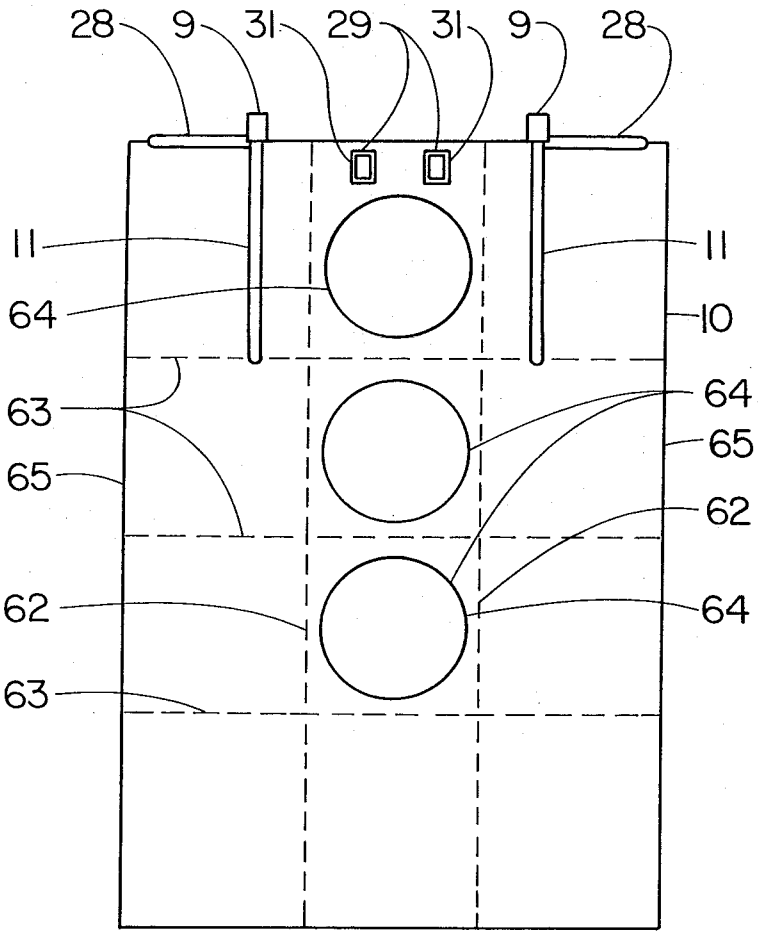
FIG. 17 is an aft elevation of the semi submersible vessel shown looking forward.

Referring to FIG. 17 there is shown an elevation view of the semi submersible vessel 10 in a vertical position. This vertical elevation is at the aft side looking in the forward direction 53 (see FIG. 11 for this directional reference).

The semi submersible vessel 10 is in the shape of a rectangle for economic purposes but it could be constructed of one or more vertical cylinders if that is desirable.

The semi submersible vessel 10 has two water tight bulkheads 62 that extend fromthe top of the semi submersible vessel 10 to the bottom. There may also be watertight horizontal decks 63 to control flooding, ballasting or buoyancy. There may also be non watertight vertical and horizontal structural members for strength purposes.

The semi submersible vessel 10 has large diameter holes 64 cut in the center section on the vertical and horizontal members to allow sea water and air to pass through said holes thus forming two water tight tanks 65. The two water tight tanks 65 are thus two water tight columns and thus make up a column stabilized vessel or a semi submersible vessel 10.

Other items shown on the semi submersible vessel 10 are the lifting beams 9, the truss 11, the diagonal brace 28, the stabilization beams 29 and the structural tunnel 31.

Figure 18:
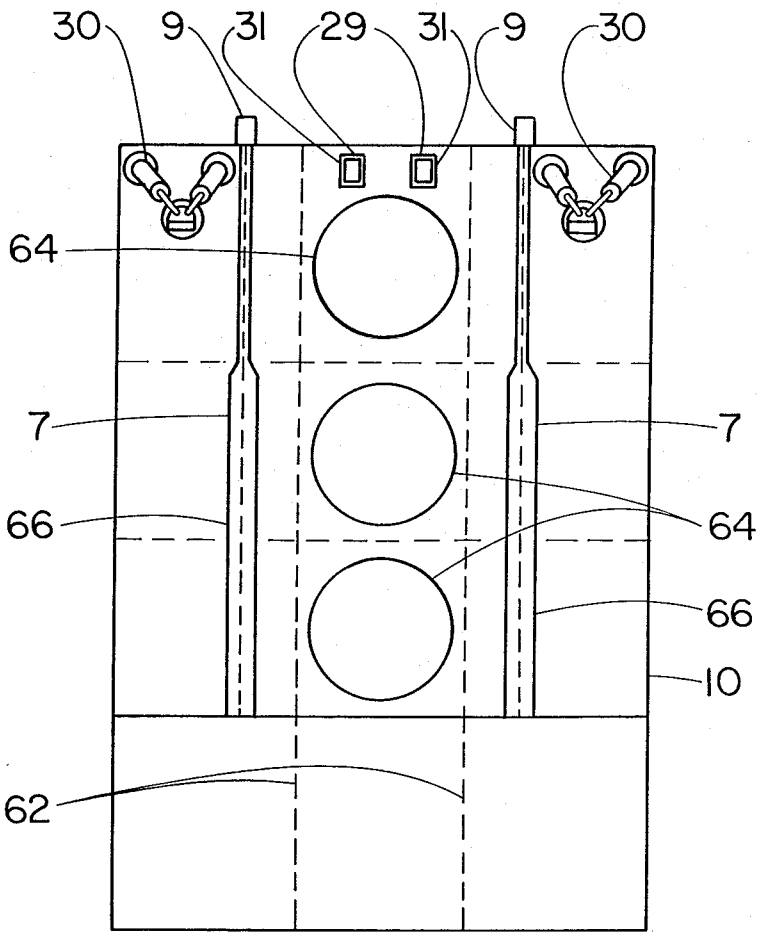
FIG. 18 is a forward elevation of the semi submersible vessel shown looking aft.

Referring to FIG. 18 there is shown still another elevation of the semi submersible vessel 10. FIG. 18 is an elevation of the forward side looking in an aft direction 54 (see FIG. 11 for this directional reference).

The curved guide frame 7 is shown with a narrow section at the top and a wider section for about three quarters of the length. The purpose for this narrow section is to allow the guide units 27 to release the curved guide frame 7 when the semi submersible vessel 10 is ballasted into a horizontal position as in FIGS. 1 and 9. The wide section of the curved guide frame 7 is the flange 66 that is slideable held by the guide unit 27 not shown in this view. The guide unit 27 will hold the flange 66 when the semi submersible vessel 10 is elevated as shown in FIGS. 5, 6 and 7. The curved guide frames 7 may be on each side of the semi submersible 10 or they may be in line with the two watertight bulk heads 62 or there may be only one curved guide frame 7 in the center of the semi submersible vessel 10; this would be a matter of design choice.

Also shown on the semi submersible vessel of FIG. 18 is the large diameter holes 64, the holdback frame 30, the stabilization beams 29, the structural tunnel 31 and the lifting beam 9.

Figure 19:
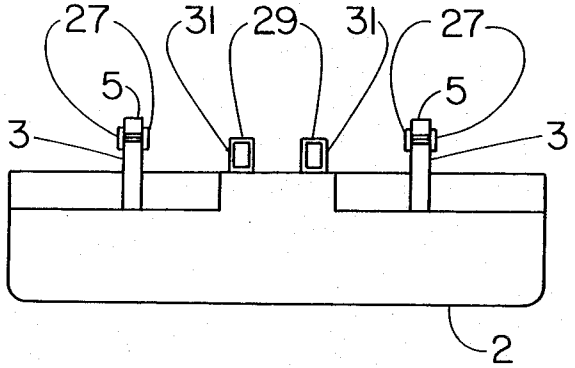
FIG. 19 is an aft elevation of the vessel shown looking forward.

Referring to FIG. 19 there is shown an elevation of the aft end of the vessel 2 shown looking in a forward direction 53 (see FIG. 11 for this reference).

Vessel 2 has a launch rail 3 on each side. On each launch rail 3 is a guide unit 27 that is laterally restraining pullback beam 5. Also shown are the two stabilization beams 29 and the structural tunnels 31.

Figure 20:
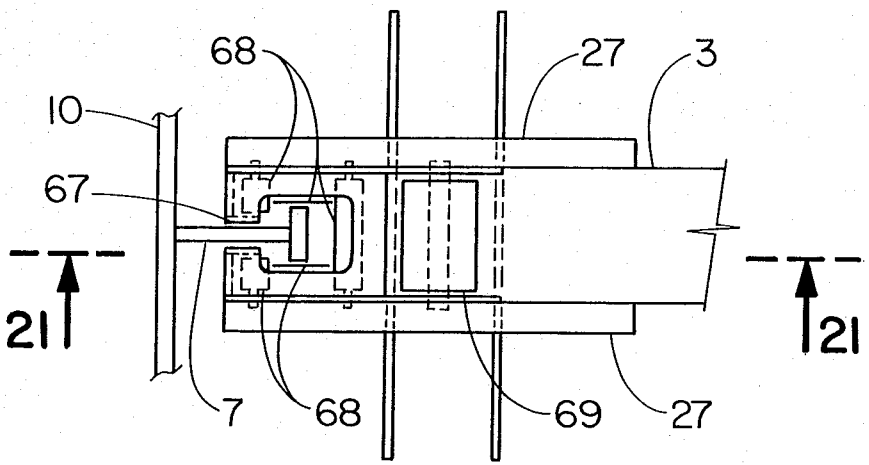
FIG. 20 is a plan view of the curved guide frame guide.

Referring to FIG. 20 there is shown a plan view of the guide unit 27.

The guide unit 27 is suitably attached to the launch rail 3 and is shown with the curved guide frame 7 held in the slot 67 of the guide unit 27. A series of rollers 68 of various sizes hold the curved guide frame 7 laterally in place while allowing the curved guide frame 7 to move vertically. The semi submersible vessel 10 could be stationary while the vessel 2 (not shown in this view) that is suitable attached to the guide unit 27, could move up or down and still hold fast to the curved guide frame 7.

The rollers 68 could also be bronze wear plates not shown or other types of plates that the curved guide frame 7 could rub on.

On the top of the guide frame there is support roller 69 that will support part of the weight of the semi submersible vessel 10 as it is being pushed off of or pulled onto the vessel 2. The support roller 69 could also be a bronze plate.

Figure 21:
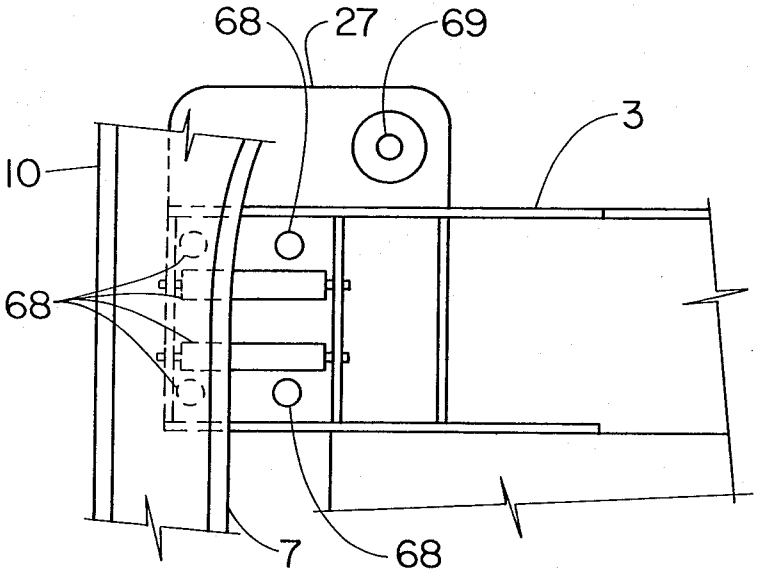
FIG. 21 is a sectional elevation of the curved guide frame guide taken from FIG. 20.

Referring to FIG. 21 there is shown a section elevation of the guide unit 27 as it is suitably fastened to the launch rail 3.

The guide unit 27 is shown with the curved guide frame 7 held in place by the rollers 68. Also shown is the support roller 69 that will support part of the weight of the semi submersible vessel 10 on the curved guide frames 7 as it is being pushed off of the vessel 2 or pulled onto the vessel 2.

The support roller 69 will be used when the semi submersible vessel 10 is in a horizontal position such as that shown in FIGS. 1, 2, and 9. The support rollers could also be bronze or steel wear plates which would be a matter of design choice.

Figure 22:
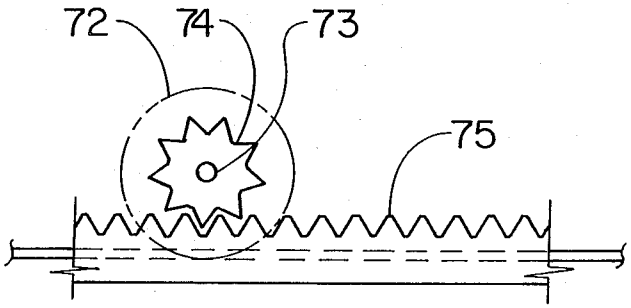
FIG. 22 is a detail of a rack and pinion propulsion system.

Referring to FIG. 22 there is shown a rack and pinion propulsion system for moving the carriage 14, the marine superstructure carriage 12 the stabilization beams 29.

The drive motor 72 that is suitably fastened to the load to be moved rotates the shaft 73 which rotates the pinion gear 74. The pinion gear 74 reacts on the rack gear 75 causing the pinion gear 74 to move on the rack gear 75 in the direction of rotation of the pinion gear 74.

Figure 23:
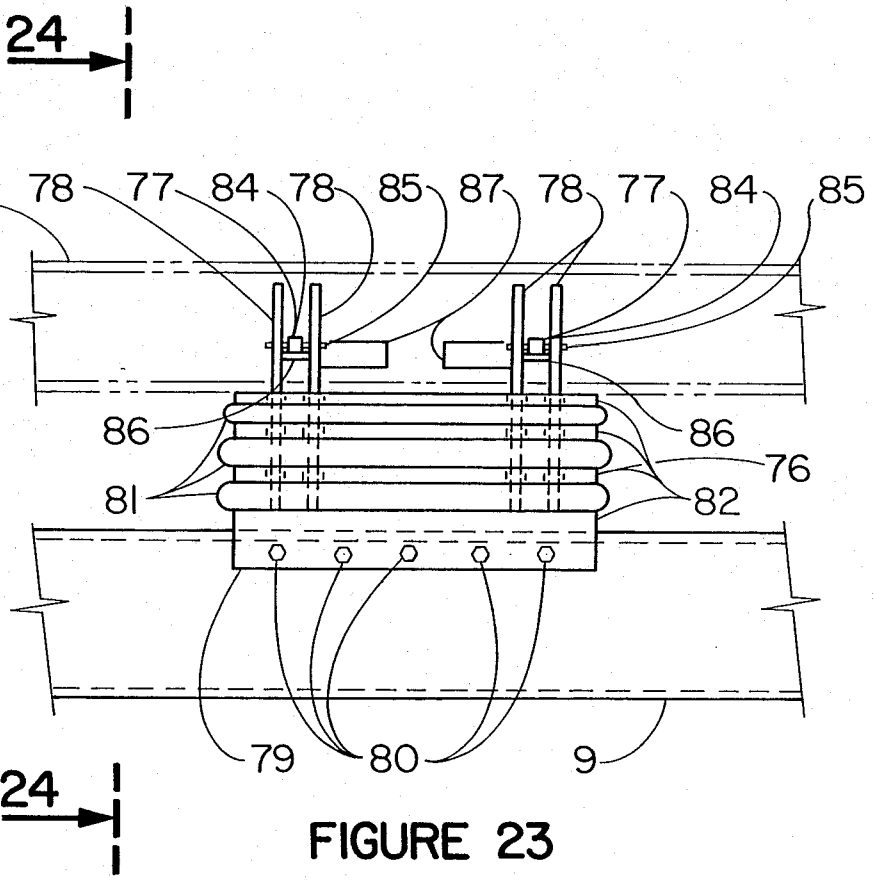
FIG. 23 is an elevation of another shock absorbing system with a guide and locking system.

Referring to FIG. 23 there is shown an elevation of a laminated shock pad 76 with a clamp 77 and guide 78.

The laminated shock pad 76 is shown setting on a saddle foundation 79 that is suitably fastened to the lifting beam 9 by bolts 80; other fastening methods could be used such as pins, clamps or welding which would be a matter of a design choice. The saddle foundation 79 is designed to be moved laterally on the lifting beam 9 to be adjusted to various structural configurations of various marine superstructures 17.

The laminated shock pad 76 is made from rubber sheets 81 or other suitable soft material sandwiched between plates 82 of steel or other suitable material. The rubber sheets 81 and plates 82 are held in place by guides 78. The guides 78 are suitably fastened to the saddle foundation 79 and enable the rubber sheets 81 and the plates 82 to remain laterally stable while still moving vertically as energy is being absorbed and dissipated.

A wide flange member 83 of the marine superstructure 17 is shown resting on top of the laminated shock pad 76. The wide flange member 83 is held in place by the clamp 77 that is made up of the latch 84, the latch pin 85, the stop pin 86 and the hydraulic cylinder 87. The operation of the clamp 77 will be further explained in FIG. 24.

Figure 24:
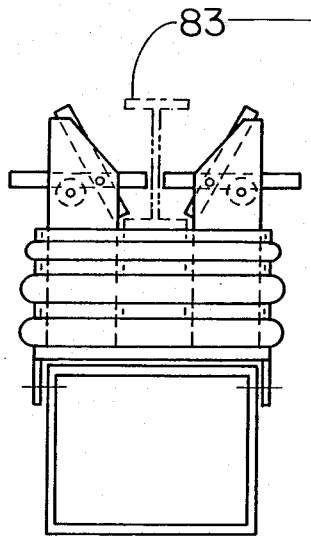
FIG. 24 is a section taken through FIG. 23.

Referring to FIG. 24 there is shown the guide 78 running through the rubber sheets 81 and the plates 82 and connected to the saddle foundation 79 that is resting on the lifting beam 9.

At the top, the guide 78 is sloped to guide the wide flange member 83 to the center of the laminated shock pad 76. When the wide flange member 83 passes into the slot 88 that is formed by the two guide members 78, the latches 84 on each side of the slot 88, rotate, allowing the wide flange member 83 to pass. When the lower flange 89 of the wide flange member 83 lands on the laminated shock pad 76, the latches 84 will rotate around the latch pins 85 into a closed position 90 thus locking in the wide flange member 83. The wide flange member 83 can be released only by withdrawing the stop 86 with the hydraulic cylinders 87.

Figure 25:
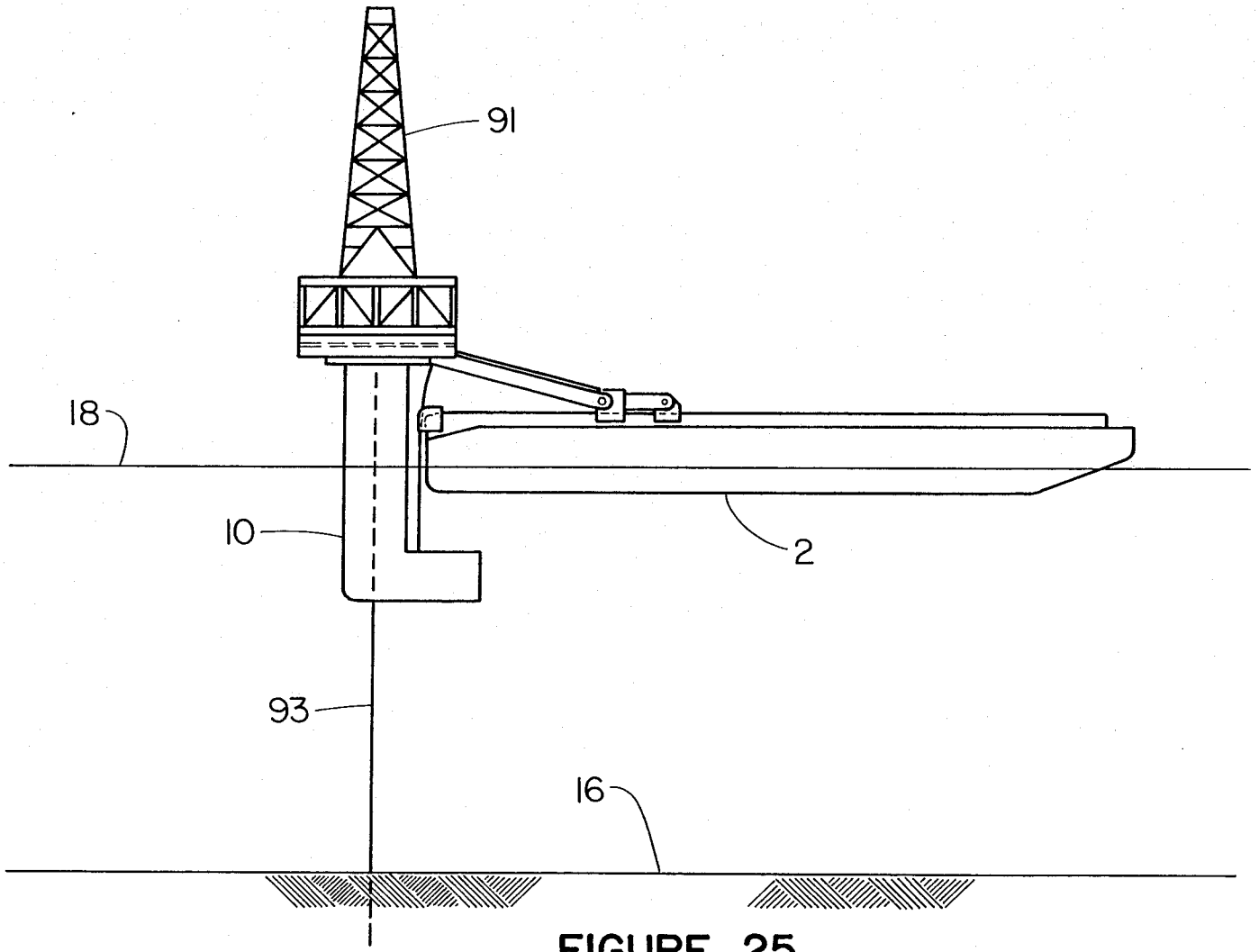
FIG. 25 is an elevation of another embodiment showing the device with a drill rig.

Referring to FIG. 25 there is shown another embodiment of how the device 1 may be used.

Since the vessel 2 exerts no influence on the motion of semi submersible vessel 10, so that the semi submersible vessel 10 will be capable of floating in a column stabilized condition without moving, while vessel 10 will bob up and down in the waves, the semi submersible vessel 10 may be used as a drilling unit.

A conventional drill rig 91 could be placed on the semi submersible vessel 10 and the vessel 2 could be used as a drilling tender 92 to support the operation of the drill rig 91.

The drill rig 91 would drill with a conventional drill string 93 from above the sea surface 18 into the sea floor 16.

The drill rig 91 would be set on the semi submersible vessel 10 in the same manner as the marine superstructure 17 is set on the semi submersible vessel in FIGS. 1, 2, 3, 4 and 5.

Figure 26:
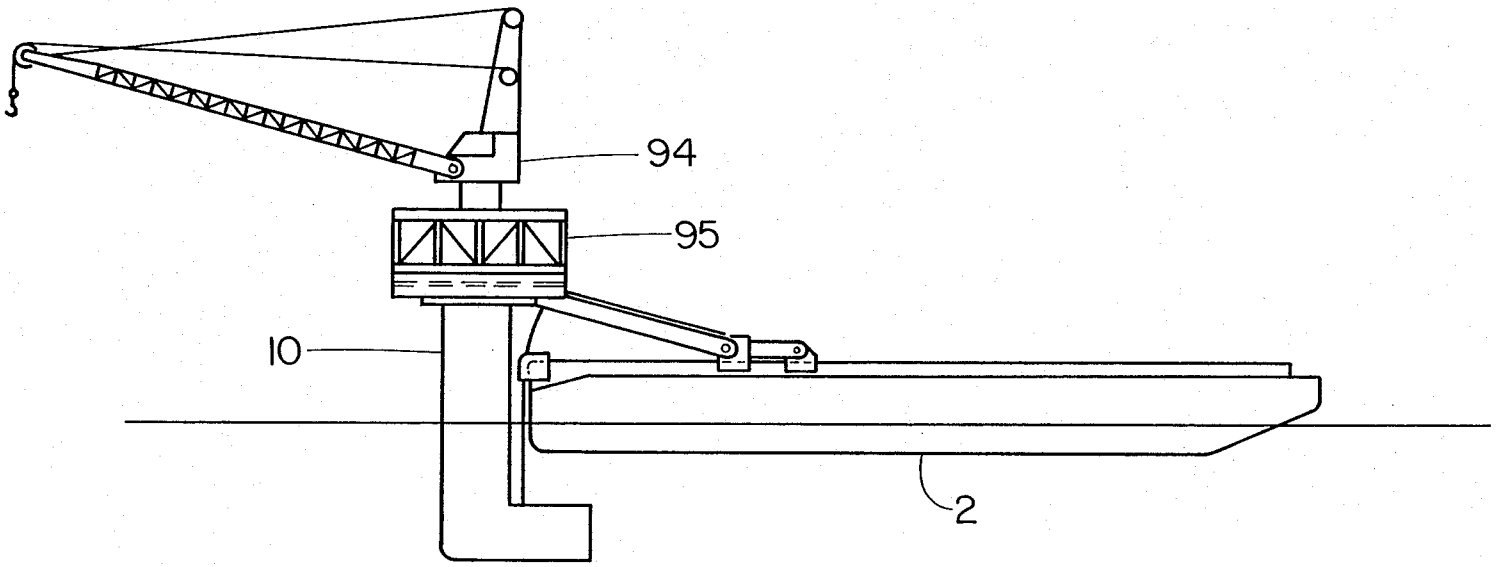
FIG. 26 is another elevation of a third embodiment showing the device with a crane.

Referring to FIG. 26 there is shown a crane 94 on top of a structure 95 in the same position as the drill rig 91 is shown in FIG. 25.

A crane 94 or any other device could be placed on top of the semi submersible vessel 10.

Although the system described in detail supra has been found to be most satisfactory and preferred, many variations in structure and method are possible. For example the tanks of the semi submersible vessel could be round, square or rectangular, the lifting beams could be transversely adjusted to suit various marine superstructures. The semi submersible vessel could be used as a work vessel that is transported on another vessel. The semi submersible vessel could have a crane or lifting device located on its deck. The semi submersible vessel could have a drill rig on its deck and be used for exploration drilling. The semi submersible vessel could be used for elevating large sections of bridges. The device could be used to remove marine superstructures from marine structures and transport the marine superstructure to shore or dump the marine superstructure at sea. The semi submersible vessel could be transported on a vessel other than the vessel that transports the marine superstructure and it could be launched in a similar manner. The semi submersible vessel could be built to a configuration that would allow it to be towed in a horizontal position to the erection site or the marine superstructure removal site without placing it on another vessel.

Although the invention has been described with reference to the preferred embodiment, it will be understood by those skilled in the art, that additions modifications, substitutions, deletions and other changes not specifically described, may be made in the embodiment herein, it should be understood that the details herein are to be interpreted as illustrative and not in a limiting sense.

What is claimed as invention is:

1. An apparatus for erecting a marine superstructure on a marine structure and further removing a marine superstructure from a marine structure, comprising:

a first vessel, said first vessel that floats on the surface of a body of water and said first vessel has at least one deck to support equipment;

at least one first rail supported on said deck of said first vessel, said first rail is placed on said deck parallel with the longitudinal axis of said first vessel;

at least one first carriage means for engaging said first rail and moving along said first rail;

at least one pullback beam with a first end and a second end, said first end is engaged with said first carriage by a pin means at said first end;

at least one semi submersible vessel that is transported essentially in a horizontal position on said first vessel and further floats in a body of water in a vertical position after it is pushed off of said first vessel;

at least one second rail mounted on said semi submersible vessel and further cantilevered from one side of said semi submersible vessel;

at least one second carriage means for engaging said second rail and moving along said second rail;

at least one shock absorber means mounted on said second carriage, said shock absorber means for engaging, supporting and dampening the shock of said second carriage with said marine superstructure as said second carriage engages or disengages said marine superstructure;

at least one hinge at said second end of said pullback beam connecting said pullback beam with said semi submersible vessel to allow said semi submersible vessel to move in a vertical direction relative to said first vessel;

at least one curved guide frame, said curved guide frame being suitably fastened on one side to one side of said semi submersible vessel and said curved guide frame forms an arc on the other side;

at least one guide unit, said guide unit fastened to said first rail and essentially forming a slot to allow the vertical passage of said curved guide frame.

2. The apparatus of claim 1 wherein said vessel is self propelled.

3. The apparatus of claim 1 wherein said first carriage is connected to a bridge platform.

4. The apparatus of claim 3 wherein said bridge platform supports equipment and components.

5. The apparatus of claim 1 wherein said first carriage is propelled along said first rail by gripper jacks.

6. The apparatus of claim 1 wherein said first carriage means is propelled along said first rail by a rack and pinion device.

7. The apparatus of claim 1 wherein said first carriage means is propelled along said first rail by a winch and cable means.

8. The apparatus of claim 1 wherein said semi-submersible vessel is formed from at least one water tight column.

9. The apparatus of claim 1 wherein said semi submersible vessel has a sponson tank connected at the bottom.

10. The apparatus of claim 1 wherein said semi submersible vessel is made from at least one square tank.

11. The apparatus of claim 1 wherein said semi submersible vessel is made from at least one rectangular tank.

12. The apparatus of claim 1 where said pullback beam is made of a box beam in section.

13. The apparatus of claim 1 wherein said shock absorber means is made of rubber.

14. The apparatus of claim 1 wherein said shock absorber means is made of rubber and steel laminates.

15. The apparatus of claim 1 wherein said shock absorber has guide means to direct and hold a marine superstructure.

16. The apparatus of claim 1 wherein said shock absorber has a locking device to hold a marine superstructure to the marine structure.

17. The apparatus of claim 1 wherein said guide unit grasps and guides said curved guide rail with rollers.

18. The apparatus of claim 1 wherein said marine superstructure is transported on said vessel with said semi submersible vessel.

19. An apparatus for use in supporting and using equipment above the surface of a body of water comprising;

a first vessel, said first vessel floats on the surface of a body of water and said first vessel has at least one deck to support equipment;

at least one first rail supported on said deck of said first vessel, said first rail is placed on said deck parallel with the longitudinal axis of said first vessel;

at least one first carriage means for engaging said first rail and moving along said first rail;

at least one pullback beam with a first end a second end, said first end is engaged with said first carriage by a pin means;

at least one semi submersible vessel that is transported essentially in a horizontal position on said first vessel and further floats in a body of water in a vertical position after it is pushed off of said first vessel;

at least one second rail mounted on said semi submersible vessel;

at least one second carriage means for engaging said second rail and moving along said second rail;

at least one hinge at said second end of said pullback beam connecting said pullback beam with said semi submersible vessel to allow said semi submersible vessel to move in a vertical direction relative to said first vessel;

at least one curved guide frame, said guide frame is suitably fastened on one side to one side of said semi submersible vessel and said curved guide frame forms an arc on the other side;

at least one guide unit, said guide unit fastened to said first rail and essentially forming a slot to allow the vertical passage of said curved guide frame.

20. The apparatus of claim 19 wherein said equipment is a drill rig.

21. The apparatus of claim 19 wherein said equipment is at least one crane.

* * * * *